US007930176B2

(12) United States Patent
Chen

(10) Patent No.: US 7,930,176 B2
(45) Date of Patent: Apr. 19, 2011

(54) PACKET LOSS CONCEALMENT FOR BLOCK-INDEPENDENT SPEECH CODECS

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1283 days.

(21) Appl. No.: 11/234,291

(22) Filed: Sep. 26, 2005

(65) Prior Publication Data

US 2006/0265216 A1 Nov. 23, 2006

Related U.S. Application Data

(60) Provisional application No. 60/682,844, filed on May 20, 2005.

(51) Int. Cl.
*G10L 21/00* (2006.01)
*G10L 19/00* (2006.01)
*G10L 21/02* (2006.01)

(52) U.S. Cl. ..... 704/228; 704/219; 704/226

(58) Field of Classification Search ..... 704/219, 704/226, 228
See application file for complete search history.

(56) References Cited

U.S. PATENT DOCUMENTS 3,703,727 A * 11/1972 Knowlton ..... 711/217
4,920,489 A 4/1990 Hubelbank et al.
5,327,520 A 7/1994 Chen
5,545,898 A * 8/1996 Gagnon et al. ..... 250/369
5,561,609 A 10/1996 Kathmann et al.
5,615,298 A 3/1997 Chen
5,699,485 A 12/1997 Shoham
5,884,010 A 3/1999 Chen et al.
5,907,822 A 5/1999 Prieto, Jr.
6,085,158 A 7/2000 Naka et al.
6,170,073 B1 1/2001 Jarvinen et al.
6,188,980 B1 2/2001 Thyssen
6,507,814 B1 1/2003 Gao
6,654,716 B2 11/2003 Bruhn et al.
6,952,668 B1 10/2005 Kapilow
6,961,697 B1 11/2005 Kapilow
(Continued)

FOREIGN PATENT DOCUMENTS

EP 0 707 308 A1 4/1996
(Continued)

OTHER PUBLICATIONS

Elsabrouty et al, "A New Hybrid Long-Term and Short-Term Prediction Algorithm for Packet Loss Erasure Over IP-Networks", Proc. Seventh International Symposium on Signal Processing and Its Applications, Jul. 2003.*

(Continued)

*Primary Examiner* — David R Hudspeth
*Assistant Examiner* — Samuel G Neway
(74) *Attorney, Agent, or Firm* — Sterne, Kessler, Goldstein & Fox P.L.L.C.

(57) ABSTRACT

A technique for performing frame erasure concealment (FEC) in a speech decoder. One or more non-erased frames of a speech signal are decoded in a block-independent manner. When an erased frame is detected, a short-term predictive filter and a long-term predictive filter are derived based on previously-decoded portions of the speech signal. A periodic waveform component is generated using the short-term predictive filter and the long-term predictive filter. A random waveform component is generated using the short-term predictive filter. A replacement frame is generated for the erased frame. The replacement frame may be generated based on the periodic waveform component, the random waveform component, or a mixture of both.

29 Claims, 5 Drawing Sheets

U.S. PATENT DOCUMENTS

| | | | | |
|---|---|---|---|---|
| 6,973,425 | B1 | 12/2005 | Kapilow | |
| 7,143,032 | B2 | 11/2006 | Chen | |
| 7,308,406 | B2 | 12/2007 | Chen | |
| 2003/0074197 | A1 * | 4/2003 | Chen | 704/262 |
| 2003/0078769 | A1 | 4/2003 | Chen | |
| 2004/0243402 | A1 * | 12/2004 | Ozawa | 704/208 |
| 2005/0154584 | A1 * | 7/2005 | Jelinek et al. | 704/219 |
| 2008/0046235 | A1 | 2/2008 | Chen | |

FOREIGN PATENT DOCUMENTS

| | | | |
|---|---|---|---|
| EP | 0 747 882 | A2 | 12/1996 |
| EP | 1 199 812 | A1 | 4/2002 |
| WO | WO 99/66494 | A1 | 12/1999 |
| WO | WO 00/63881 | A1 | 10/2000 |
| WO | WO 03/102921 | A1 | 12/2003 |

OTHER PUBLICATIONS

Watkins, Craig R. et al., "Improving 16KB/s G.728 LD-CELP Speech Coder for Frame Erasure Channels," Acoustics, Speech, and Signal Processing, 1995. ICASSP-95., 1995 International Conference on Detroit, MI, USA May 9-12, 1995, New York, NY, USA, IEEE, US, May 9, 1995, pp. 241-244.

ITU-T Study Group 16: "Frame or Packet Loss Concealment for the LD-CELP Decoder," ITU-T Recommendation G. 728 Annex 1, May 27, 1999, pp. 1-19.

Goodman, David J. et al., "Waveform Substitution Techniques for Recovering Missing Speech Segments in Packet Voice Communications," IEEE Transactions on Acoustics, Speech and Signal Processing, IEEE Inc., New York, US, vol. ASSP-34, No. 6, Dec. 1986, pp. 1440-1448.

Chen, Juin-Hwey, "A High-Fidelity Speech and Audio Codec with Low Delay and Low Complexity," ICASSP 2000, vol. 2, Jun. 5, 2000, pp. 1161-1164.

Anonymous, "Frame or Packet Loss Concealment for the LD-CELP Decoder," International Telecommunication Union, Geneva, CH, May 1999, 13 pages.

Kim, Hong K., "A Frame Erasure Concealment Algorithm Based on Gain Parameter Re-estimation for CELP Coders," Sep. 2001, IEEE Signal Processing Letters, vol. 8, No. 9, pp. 252-256. cited by other.

ITU-T G.711, Appendix I: "A High Quality Low-Complexity Algorithm for Packet Loss Concealment with G.711", Sep. 1999. cited by other.

Malvar, Henrique S., "Biorthogonal and Nonuniform Lapped Transforms for Transform Coding with Reduced Blocking and Ringing Artifacts," IEEE Transactions of Signal Processing, IEEE Service Center, New York, NY, US, vol. 46, No. 4, Apr. 1, 1998.

Partial European Search Report, dated Dec. 8, 2010, European Application No. EP 06 00 4369.

* cited by examiner

PACKET LOSS CONCEALMENT FOR BLOCK-INDEPENDENT SPEECH CODECS

CROSS REFERENCE TO RELATED APPLICATIONS

This application claims the benefit of provisional application No. 60/682,844, filed May 20, 2005, which is incorporated by reference herein in its entirety.

BACKGROUND OF THE INVENTION

1. Field of the Invention

The present invention relates to digital communication systems. More particularly, the present invention relates to the enhancement of speech quality when portions of a bit stream representing a speech signal are lost within the context of a digital communications system.

2. Background Art

In speech coding (sometimes called "voice compression"), a coder encodes an input speech or audio signal into a digital bit stream for transmission. A decoder decodes the bit stream into an output speech signal. The combination of the coder and the decoder is called a codec. The transmitted bit stream is usually partitioned into frames, and in packet transmission networks, each transmitted packet may contain one or more frames of a compressed bit stream. In wireless or packet networks, sometimes the transmitted frames or packets are erased or lost. This condition is called frame erasure in wireless networks and packet loss in packet networks. When this condition occurs, to avoid substantial degradation in output speech quality, the decoder needs to perform frame erasure concealment (FEC) or packet loss concealment (PLC) to try to conceal the quality-degrading effects of the lost frames. Because the terms FEC and PLC generally refer to the same kind of technique, they can be used interchangeably. Thus, for the sake of convenience, the term "frame erasure concealment", or FEC, is used herein to refer to both.

One of the earliest FEC techniques is waveform substitution based on pattern matching, as proposed by Goodman, et al. in "Waveform Substitution Techniques for Recovering Missing Speech Segments in Packet Voice Communications", *IEEE Transaction on Acoustics, Speech and Signal Processing*, December 1986, pp. 1440-1448. This scheme was applied to a Pulse Code Modulation (PCM) speech codec that performs sample-by-sample instantaneous quantization of a speech waveform directly. This FEC scheme uses a piece of decoded speech waveform that immediately precedes the lost frame as a template, and then slides this template back in time to find a suitable piece of decoded speech waveform that maximizes some sort of waveform similarity measure (or minimizes a waveform difference measure).

Goodman's FEC scheme then uses the section of waveform immediately following a best-matching waveform segment as the substitute waveform for the lost frame. To eliminate discontinuities at frame boundaries, the scheme also uses a raised cosine window to perform an overlap-add operation between the correctly decoded waveform and the substitute waveform. This overlap-add technique increases the coding delay. The delay occurs because at the end of each frame, there are many speech samples that need to be overlap-added, and thus final values cannot be determined until the next frame of speech is decoded.

Based on the work of Goodman as described above, David Kapilow developed a more sophisticated version of an FEC scheme for the G.711 PCM codec. This FEC scheme is described in Appendix I of the ITU-T Recommendation G.711.

The FEC scheme of Goodman and the FEC scheme of Kapilow are both limited to PCM codecs that use instantaneous quantization. Such PCM codecs are block-independent; that is, there is no inter-frame or inter-block codec memory, so the decoding operation for one block of speech samples does not depend on the decoded speech signal or speech parameters in any other block.

All PCM codecs are block-independent codecs, but a block-independent codec does not have to be a PCM codec. For example, a codec may have a frame size of 20 ms, and within this 20 ms frame there may be some codec memory that makes the decoding of certain speech samples in the frame dependent on decoded speech samples or speech parameters from other parts of the frame. However, as long as the decoding operation of each 20 ms frame does not depend on decoded speech samples or speech parameters from any other frame, then the codec is still block-independent.

One advantage of a block-independent codec is that there is no error propagation from frame to frame. After a frame erasure, the decoding operation of the very next good frame of transmitted speech data is completely unaffected by the erasure of the immediately preceding frame. In other words, the first good frame after a frame erasure can be immediately decoded into a good frame of output speech samples.

For speech coding, the most popular type of speech codec is based on predictive coding. Perhaps the first publicized FEC scheme for a predictive codec is a "bad frame masking" scheme in the original TIA IS-54 VSELP standard for North American digital cellular radio (rescinded in September 1996). The first FEC scheme for a predictive codec that performs waveform extrapolation in the excitation domain is probably the FEC system developed by Chen for the ITU-T Recommendation G.728 Low-Delay Code Excited Linear Predictor (CELP) codec, as described in U.S. Pat. No. 5,615,298 issued to Chen, entitled "Excitation Signal Synthesis During Frame Erasure or Packet Loss." After the publication of these early FEC schemes for predictive codecs, many, many other FEC schemes have been proposed for predictive codecs, some of which are quite sophisticated.

Despite the fact that most of the speech codecs standardized in the last 15 years are predictive codecs, there are still some applications, such as Voice over Internet Protocol (VoIP), where the G.711 (8-bit logarithmic PCM) codec, or even the 16-bit linear PCM codec, is still used in order to ensure a very high signal fidelity. In such applications, none of the advanced FEC schemes developed for predictive codecs can be used, and typically G.711 Appendix I (Kapilow's FEC scheme) is used instead. However, G.711 Appendix I has the following drawbacks: (1) it requires an additional delay of 3.75 ms due to overlap-add, (2) it has a fairly large state memory requirement due to the use of a long history buffer with a length of three and a half times the maximum pitch period, (3) its performance is not as good as it can be.

What is needed therefore is an FEC technique for block-independent speech codecs that avoids the noted deficiencies associated with G.711 Appendix I. In particular, it is desirable for the FEC not to add additional delay. It is also desirable to have a state memory that is as small as possible. It is further desirable to achieve speech quality better than that produced by G.711 Appendix I.

SUMMARY OF THE INVENTION

Consistent with the principles of the present invention as embodied and broadly described herein, an exemplary FEC technique includes deriving a filter by analyzing previously decoded speech, setting up the internal state (memory) of such a filter properly, calculating the "ringing" signal of the filter, and performing overlap-add operation of the resulting filter ringing signal with an extrapolated waveform to ensure a smooth waveform transition near frame boundaries without requiring additional delay as in G.711 Appendix I. In the context of the present invention, the "ringing" signal of a filter is the output signal of the filter when the input signal to the filter is set to zero. The filter is chosen such that during the time period corresponding to the last several samples of the last good frame before a lost frame, the output signal of the filter is identical to the decoded speech signal. Due to the generally non-zero internal "states" (memory) of the filter at the beginning of a lost frame, the output signal is generally non-zero even when the filter input signal is set to zero starting from the beginning of a lost frame. A filter ringing signal obtained this way has a tendency to continue the waveform at the end of the last good frame into the current lost frame in a smooth manner (that is, without obvious waveform discontinuity at the frame boundary). In one embodiment, the filter includes both a long-term predictive filter and a short-term predictive filter.

A long-term predictive filter normally requires a long signal buffer as its filter memory, thus adding significantly to the total memory size requirement. An embodiment of the present invention achieves a very low memory size requirement by not maintaining a long buffer for the memory of the long-term predictive filter, but calculate the necessary portion of the filter memory on-the-fly when needed, and this is done in addition to using a speech history buffer with a length of only 1 times the maximum pitch period plus the length of a predefined analysis window (rather than three and a half times as in G.711 Appendix I).

In one embodiment of the present invention, the long-term and short-term predictive filters are used to generate the ringing signal for overlap-add operation at the beginning of every bad (i.e. lost) frame and the first good (i.e. received) frame after a frame erasure.

In another embodiment of the present invention, the long-term and short-term predictive filters are used to generate the ringing signal for overlap-add operation at the beginning of only the first bad frame of each occurrence of frame erasure. From the second consecutive bad frame on until the first good frame after the erasure, in place of the filter ringing signal, the system continues the waveform extrapolation of the previous frame to obtain a smooth extension of the speech waveform from the previous frame to the current frame, and use such an extended waveform for overlap-add operation with the newly extrapolated waveform obtained specifically for the current bad frame or the decoded good waveform for the first good frame after the frame erasure.

According to a feature of the present invention, the length of overlap-add is individually tuned for bad frames and for the first good frame after a frame erasure, and the two optimal overlap-add lengths are generally different.

According to another feature of the present invention, even the overlap-add length for the first good frame after a frame erasure is adaptively switched between a short length for unvoiced speech and a longer length for voiced speech.

According to yet another feature of the present invention, if the current frame of speech being reconstructed is believed to be purely voiced (nearly periodic), then periodic waveform extrapolation is performed; if the current frame of speech is believed to be purely unvoiced, then the waveform extrapolation is performed by passing a properly scaled random white noise sequence through a short-term predictive filter (normally known as the "LPC synthesis filter" in the literature); if the current frame of speech is somewhere between these two extremes, then the waveform extrapolation is performed by using a mixing model that mixes a periodic component and the random component mentioned above, with the proportion of the periodic component roughly proportional to the degree of periodicity.

According to yet another feature of the present invention, a computationally efficient and memory efficient method is used to generate the random white noise sequence mentioned above. The method is based on equal-distance sampling and modulo indexing a stored table of N random white noise samples, where the distance between samples depends on the frame index, and N is the smallest prime number that is greater than the number of random white noise samples that need to be generated in an erased frame.

Further features and advantages of the present invention, as well as the structure and operation of various embodiments of the present invention, are described in detail below with reference to the accompanying drawings. It is noted that the invention is not limited to the specific embodiments described herein. Such embodiments are presented herein for illustrative purposes only. Additional embodiments will be apparent to persons skilled in the art based on the teachings contained herein.

BRIEF DESCRIPTION OF THE DRAWINGS/FIGURES

The accompanying drawings, which are incorporated herein and form a part of the specification, illustrate one or more embodiments of the present invention and, together with the description, further serve to explain the purpose, advantages, and principles of the invention and to enable a person skilled in the art to make and use the invention.

The features and advantages of the present invention will become more apparent from the detailed description set forth below when taken in conjunction with the drawings. The drawing in which an element first appears is indicated by the leftmost digit(s) in the corresponding reference number.

DETAILED DESCRIPTION OF INVENTION

Figure 1:
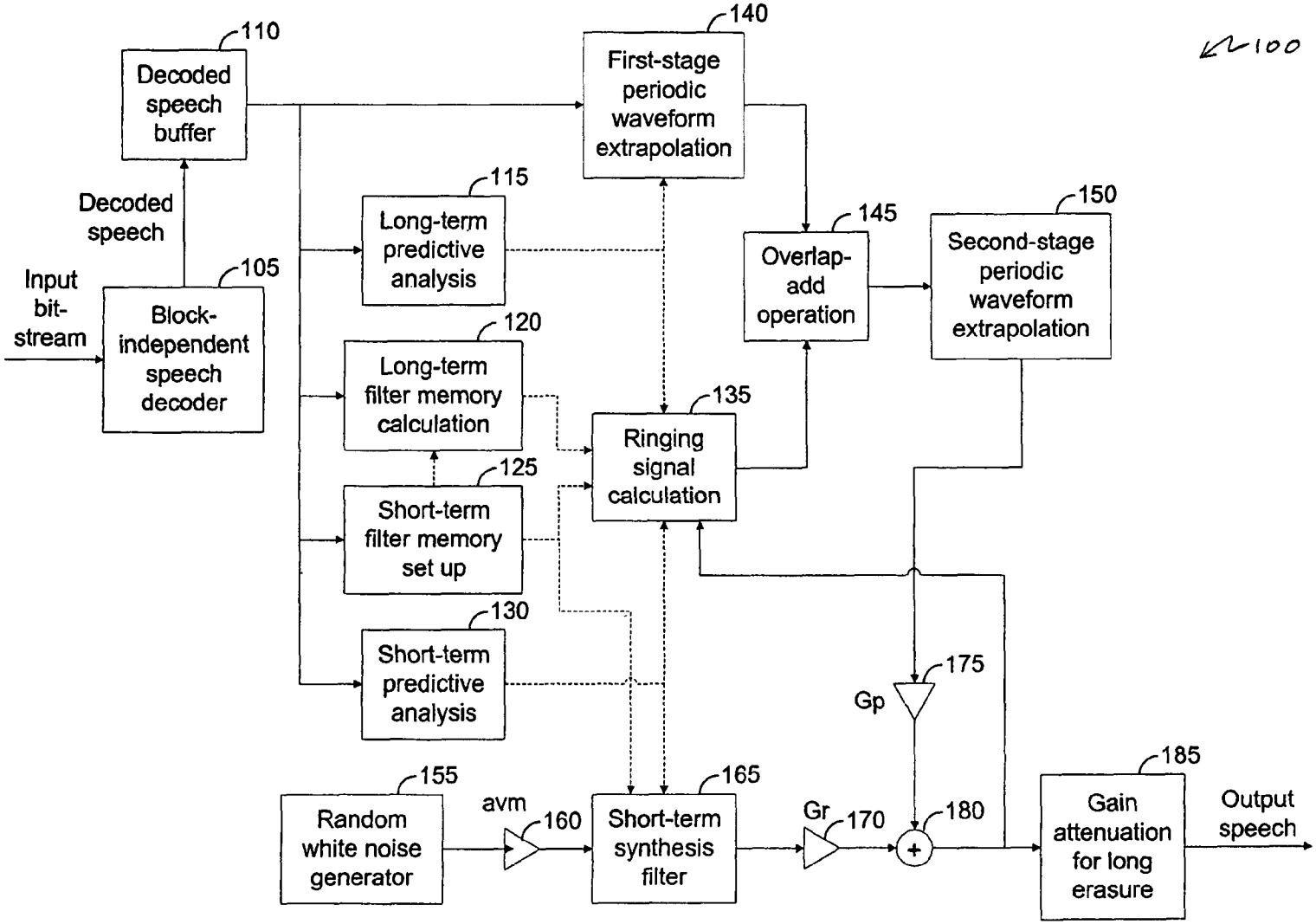
FIG. 1 is a block diagram of a preferred embodiment of the present invention.

The following detailed description of the present invention refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

It would be apparent to persons skilled in the art that the present invention, as described below, may be implemented in many different embodiments of hardware, software, firmware, and/or the entities illustrated in the drawings. Any actual software code with specialized control hardware to implement the present invention is not limiting of the present invention. Thus, the operation and behavior of the present invention will be described with the understanding that modifications and variations of the embodiments are possible, given the level of detail presented herein. Before describing the invention in detail, it is helpful to describe an exemplary environment in which the invention may be implemented.

A. SPEECH DECODER IMPLEMENTATION IN ACCORDANCE WITH AN EMBODIMENT OF THE PRESENT INVENTION

The present invention is particularly useful in the environment of the decoder of a block-independent speech codec to conceal the quality-degrading effects of frame erasure or packet loss. The general principles of the invention can be used in any block-independent codec. However, the invention is not limited to implementation in a block-independent codec, and the techniques described below may also be applied to other types of codecs such as predictive codecs. An illustrative block diagram of a preferred embodiment 100 of the present invention is shown in FIG. 1.

In accordance with the preferred embodiment, each frame of a speech signal received at the decoder is classified into one of the following five different classes:

(1) the first erased (bad) frame of a cluster of consecutively erased frames; if an erasure consists of only one bad frame, then that bad frame falls into this category, (2) the second bad frame of a cluster of consecutively erased frames if there are two or more frames in an erasure, (3) a bad frame that is neither the first nor the second bad frame of an erasure, (4) the first received (good) frame immediately after an erasure, (5) a good frame that is not the first good frame immediately after an erasure.

Figure 2:
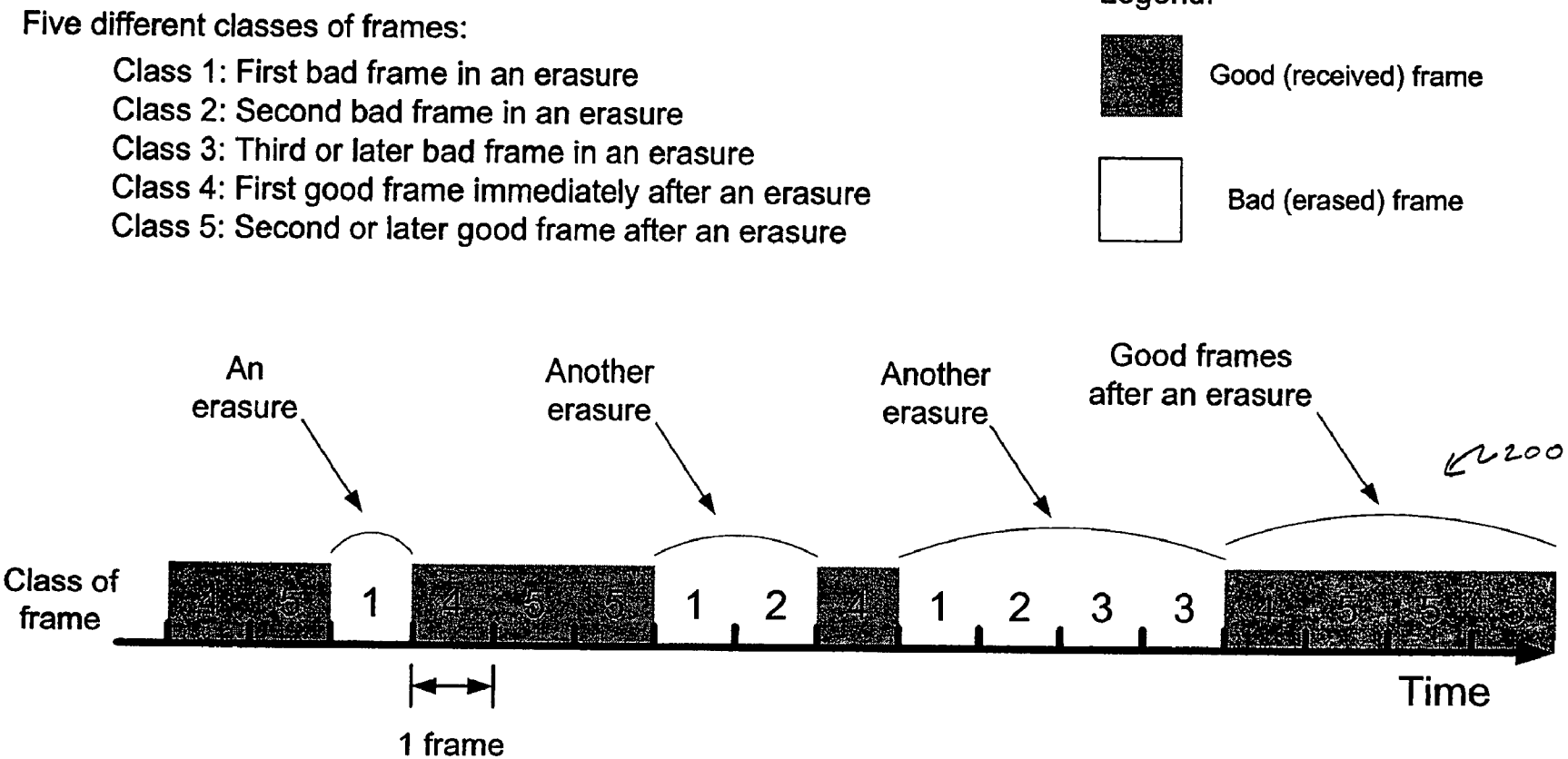
FIG. 2 is an illustration of different classes of frames distinguished by an embodiment of the present invention.

FIG. 2 shows a series of frames 200 of a speech signal that illustrates five different classes of frames distinguished by the preferred embodiment of the present invention. In FIG. 2, the long horizontal arrowed line is a time line, with each vertical tick showing the location of the boundary between two adjacent frames. The further to the right a frame is located in FIG. 2, the newer (later) the frame is. Shaded frames are the "good" frames, or those frames that are received without transmission errors by the speech decoder. Frames without shade are the "bad" frames, or those frames not received by the decoder or badly corrupted at the decoder, and thus considered "erased". A cluster of two or more consecutive bad frames is referred to herein as a single "erasure".

The preferred embodiment of the present invention performs different tasks for different classes of frames; furthermore, the calculation result of a task performed for a certain class of frames may be used later for other classes of frames. For this reason, it is difficult to illustrate the frame-by-frame operation of such an FEC scheme by a conventional block diagram.

To overcome this problem, FIG. 1 is drawn as a special kind of block diagram for an exemplary embodiment 100 of the present invention. FIG. 1 aims to illustrate the fundamental concept rather than the step-by-step, module-by-module operation. Individual functional blocks in FIG. 1 may be inactive or bypassed, depending on which class the current frame belongs to. The following text description will make it clear which functional blocks are active during which class of frames. Also, to describe the sequence of operations and control flow more clearly, a flowchart of a preferred method for implementing the present invention is set forth in FIG. 3 and FIG. 4.

A high-level description of the block diagram 100 of FIG. 1 will be provided first. After that, a detailed description of the flowchart of FIGS. 3 and 4 will be provided.

Referring now to FIG. 1, the solid arrows indicate the flow of speech signals or other related signals. The arrows with dashed lines indicate the control flow involving the updates of filter parameters, filter memory, and the like.

The case in which the current frame is a good frame will now be described. For a good frame, block 105 decodes the input bit stream into the current frame of a decoded speech signal, and passes it to block 110 to store in a decoded speech buffer; then, blocks 115, 125, and 130 are activated. In the preferred implementation, the decoded speech buffer is one times a maximum pitch period plus a predefined analysis window size. The maximum pitch period may be, for example, between 17 and 20 ms, while the analysis window size may be between 5 and 10 ms.

Using the decoded speech signal stored in the buffer, block 115 performs long-term predictive analysis to derive the long-term filter parameters (pitch period, tap weight, and the like). Similarly, block 130 performs short-term predictive analysis to derive the short-term filter parameters and calculates the average magnitude of the short-term prediction residual signal in the current frame. The short-term filter and the short-term prediction residual are also called the LPC (Linear Predictive Coding) filter and LPC prediction residual, respectively, in the speech coding literature. Block 125 takes the last few samples of the decoded speech in the current frame, reverses the order, and saves them as short-term filter memory.

If the current frame is a good frame that is not the first good frame immediately after an erasure (that is, a class-5 frame), then blocks 135, 155, 160, 165, and 170 are inactive, and blocks 140, 145, 150, 175, 180, and 185 are bypassed. In other words, the current frame of decoded speech is directly played out as the output speech signal.

If, on the other hand, the current frame is the first good frame immediately after an erasure (that is, a class-4 frame), then in the immediate last frame (that is, the last bad frame of the last erasure), there should be a segment of ringing signal already calculated and stored in block 135 (to be explained later). In this case, blocks 155, 160, 165, and 170 are also inactive, and block 140 is bypassed. Block 145 performs the overlap-add operation between the ringing signal segment stored in block 135 and the decoded speech signal stored in block 110 to get a smooth transition from the stored ringing signal to the decoded speech. This is done to avoid waveform discontinuity at the beginning of the current frame. The overlap-add length is typically shorter than the frame size. After the overlap-add period, block 145 fills the rest of the current frame with the corresponding samples in the decoded speech signal stored in block 110. Blocks 150, 175, 180, and 185 are then bypassed. That is, the overlap-added version of the current frame of decoded speech is directly played out as the output speech signal.

If the current frame is the first bad frame in an erasure (that is, a class-1 frame), block 115 does not extract the pitch period or tap weight (it will just use the values extracted for the last good frame), but it calculates a voicing measure to determine how periodic the decoded speech signal stored in block 110 is. This voicing measure is later used to control the gain values Gp and Gr of blocks 175 and 170, respectively. In addition, block 115 also calculates the pitch period change per frame averaged over the last few frames. Block 120 calculates the long-term filter memory by using a short-term filter to inverse-filter the decoded speech only for the segment that is one pitch period earlier than the overlap-add period at the beginning of the current frame. The result of the inverse filtering is the "LPC prediction residual" as known in the speech coding literature. Block 135 then scales the long-term filter memory segment so calculated by the long-term filter tap weight, and then passes the resulting signal through a short-term synthesis filter whose coefficients were updated in the last frame by block 130 and whose filter memory was set up also in the last frame by block 125. The output signal of such a short-term synthesis filter is the ringing signal to be used at the beginning of the current frame (the first bad frame in an erasure).

Next, block 140 performs the first-stage periodic waveform extrapolation of the decoded speech up to the end of the overlap-add period, using the pitch period and an extrapolation scaling factor determined by block 115 during the last good frame. Specifically, block 140 multiplies the decoded speech waveform segment that is one pitch period earlier than the current overlap-add period by the extrapolation scaling factor, and saves the resulting signal segment in the location corresponding to the current overlap-add period. Block 145 then performs the overlap-add operation to get a smooth transition from the ringing signal calculated by block 135 to the extrapolated speech signal generated by block 140. Next, block 150 takes over and performs the second-stage periodic waveform extrapolation from the end of the overlap-add period of the current frame to the end of the overlap-add period in the next frame (which is the end of the current frame plus the overlap-add length). Both the current frame portion of the extrapolated waveform and the overlap-add period from the next frame from block 150 is then scaled by the gain value Gp in block 175 before being sent to adder 180.

Separately, block 155 generates a random white noise sequence for the current frame plus the overlap-add period of the next frame. (Details to be discussed later.) This white noise sequence is scaled by block 160 using a gain value of avm, which is the average magnitude of the LPC prediction residual signal of the last frame, calculated by block 130 during the last frame. Block 165 then filters the scaled white noise signal to produce the filtered version of the scaled white noise. The output of block 165 is further scaled by the gain value Gr in block 170 before being sent to adder 180.

The scaling factors Gp and Gr are the gain for periodic component and the gain for random component, respectively. The values of Gp and Gr are controlled by the voicing measure calculated in block 115. If the voicing measure indicates that the decoded speech signal stored in the buffer of block 110 is essentially periodic, then Gp=1 and Gr=0. On the other hand, if the voicing measure indicates that the decoded speech is essentially unvoiced or exhibits essentially no periodicity, then Gp=0 and Gr=1. If the voicing measure is somewhere between these two extremes, then both Gp and Gr are non-zero, with Gp roughly proportional to the degree of periodicity in the decoded speech, and with Gp+Gr=1.

The periodic signal component (the output of block 150) and the random signal component (the output of block 165) are scaled by Gp and Gr, respectively, and the resulting two scaled signal components are added together by the adder 180. Such addition operation is done for the current frame plus the overlap-add length at the beginning of the next frame. These extra samples beyond the end of the current frame are not needed for generating the output samples of the current frame. They are calculated now and stored as the ringing signal for the overlap-add operation by block 145 for the next frame.

If the current frame is not too "deep" into the erasure, that is, if it is not too far from the onset of the current cluster of consecutively erased frames, then block 185 is bypassed and the output of the adder 180 is directly played out as the output speech. If the current frame exceeds a certain distance threshold from the onset of the current erasure, then block 185 applies gain attenuation to the output waveform of the adder 180, so that the farther the current frame is from the onset of the current erasure, the more gain attenuation is applied, until the waveform magnitude reaches zero.

Note that the above description assumes that both the periodic signal component (the output of block 150) and the random signal component (the output of block 165) are calculated. This could make the program control simpler. However, it may result in wasted calculation. A computationally more efficient approach is to check the voicing measure first, then skip the calculation of the periodic component if the voicing measure is such that Gp will be set to zero, and skip the calculation of the random component if the voicing measure is such that Gr will be set to zero.

If the current frame is the second bad frame in an erasure (that is, a class-2 frame), blocks 120, 125, 130, and 135 are inactive. Block 115 derives a new pitch period by adding the average pitch period change per frame, which was calculated during the last frame (class-1 frame), to the pitch period of the last frame. Block 140 works the same way as in a class-1 frame using this new pitch period calculated by block 115. Block 145 also works the same way as in a class-1 frame, except that the ringing signal it uses now is different. Specifically, rather than using the output of block 135, now block 145 uses the ringing signal stored in the last frame as the extra output samples of block 180 beyond the end of the last frame (a class-1 frame). Blocks 150, 155, 160, 165, 170, 175, 180, and 185 all work the same way as in a class-1 frame.

If the current frame is a bad frame that is neither the first nor the second bad frame of an erasure (that is, a class-3 frame), then all blocks in FIG. 1 works the same way as in a class-2 frame, except that block 115 does not add the average pitch period change per frame to the pitch period of the last frame. Instead, it simply re-uses the pitch period of the last frame as the output pitch period given to block 140. This completes the description of the block diagram of FIG. 1.

B. FRAME ERASURE CONCEALMENT METHOD IN ACCORDANCE WITH AN EMBODIMENT OF THE PRESENT INVENTION

Figure 3:
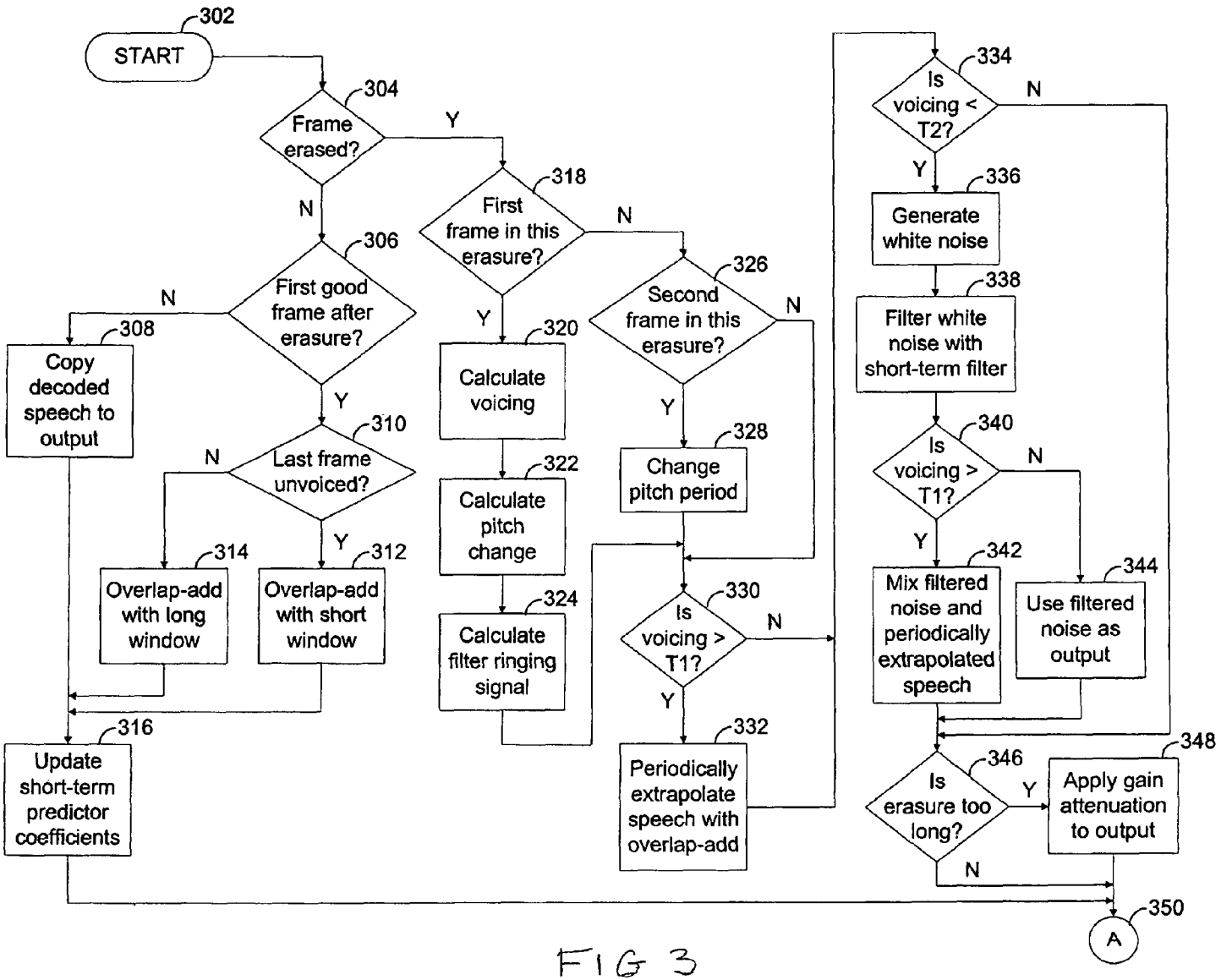
FIG. 3 is the first part of a flowchart of a preferred method of implementing the present invention.
Figure 4:
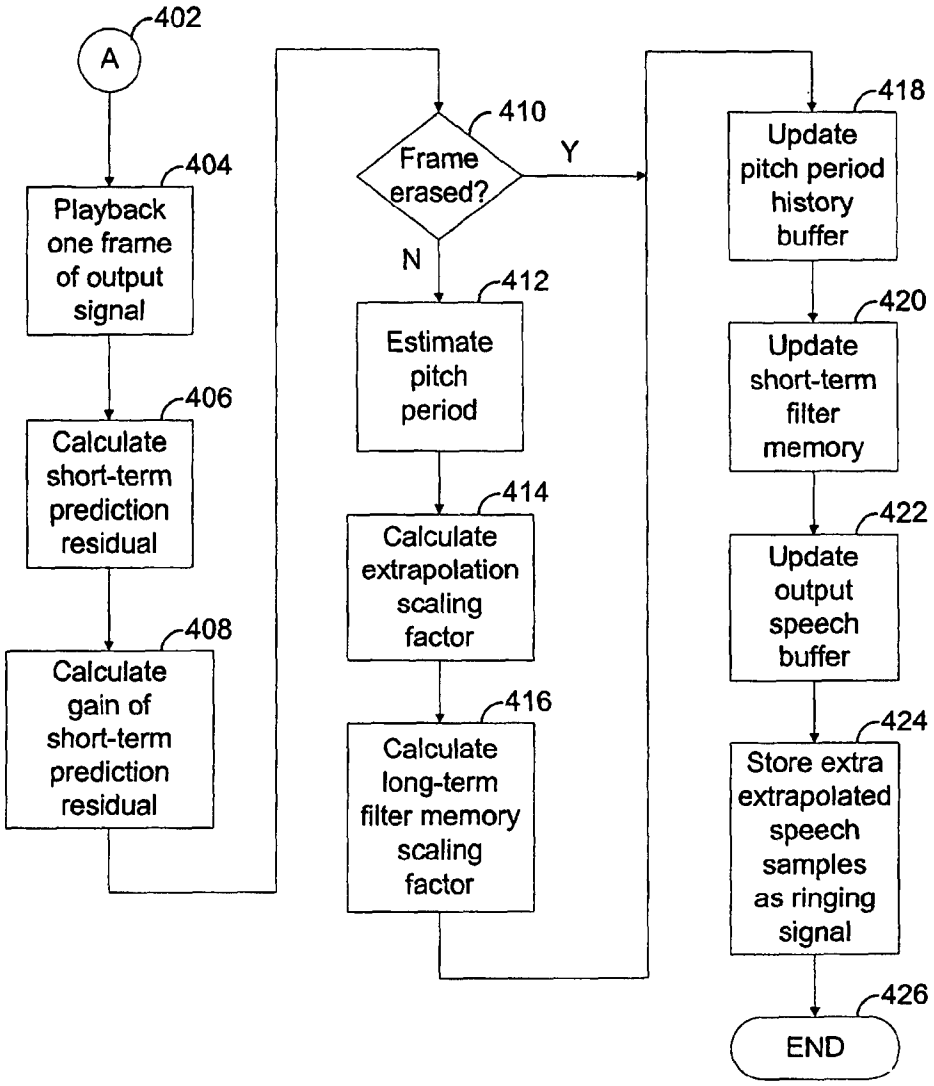
FIG. 4 is the second part of the flowchart of the preferred method of implementing the present invention.

In the following, the flowchart of a preferred method for implementing the present invention, as given in FIG. 3 and FIG. 4, will be described. FIGS. 3 and 4 correspond to a single flowchart that describes the steps for processing one frame of a speech signal. However, this flow chart is too big to fit on one page. Therefore, it is divided into two parts as shown in FIG. 3 and FIG. 4, with a node "A" as the connecting point between the two parts.

In this flowchart, the left one-third of FIG. 3 (steps 306 through 316) corresponds to the processing that is performed only during good frames, the right two-thirds of FIG. 3 (steps 318 through 348) correspond to the processing that is performed only during bad frames.

With reference to FIG. 3, the processing of each frame starts at node 302 at the upper left corner, labeled "START". The first processing step is to determine whether the current frame is erased or not at decision step 304. If the answer is "No" (that is, the current frame is a good frame), then decision step 306 further determines whether the current frame is the first good frame after an erasure. If the answer is "No" (that is, the current frame is a class-5 frame), process 308 copies the decoded speech samples in the current frame to a corresponding location in the output buffer.

If the answer to decision step 306 is "Yes" (that is, the current frame is a class-4 frame), then decision step 310 further determines whether the last frame of output decoded speech signal is considered "unvoiced". If the answer is "Yes", then process 312 performs an overlap-add (OLA) operation using a short overlap-add window. The OLA is performed between two signals: (1) the current frame of decoded speech, and (2) the ringing signal calculated in the last frame for the beginning portion of the current frame, such that the output of the OLA operation gradually transitions from the ringing signal to the decoded speech of the current frame. Specifically, the ringing signal is "weighted" (that is, multiplied) by a "ramp-down" window that goes from 1 to 0, and the decoded speech is weighted by a "ramp-up" window that goes from 0 to 1. The two window-weighted signals are summed together, and the resulting signal is placed in the portion of the output buffer corresponding to the beginning portion of the current frame. The sum of the ramp-down window and the ramp-up window at any given time index is 1. Typical windows such as the triangular window or raised cosine window can be used. Such OLA operation is well known by persons skilled in the art. An example length of the short window (or the overlap-add length) used in process 312 is on the order of 1 ms, which is 8 samples for 8 kHz telephone-bandwidth speech and 16 samples for 16 kHz wideband speech. The OLA length for unvoiced speech is made relatively short to avoid occasional dips in the magnitude of the OLA output signal. From the end of the overlap-add period to the end of the current frame, process 312 simply copies the corresponding portion of the decoded speech samples in the current frame to the corresponding portion in the output buffer.

If the answer to decision step 310 is "No", then process 314 performs a similar overlap-add operation using a long overlap-add window. Process 314 is essentially identical to process 312. The only difference is that a longer overlap-add length, at least 2.5 ms long, is used in process 314.

After process 308, 312, or 314 is completed, the control flows to process 316, which performs a so-called "LPC analysis", which is well-known by persons skilled in the art, to update the short-term predictor coefficients. Let M be the filter order of the short-term predictor, then the short-term predictor can be represented by the transfer function $$P(z) = \sum_{i=1}^{M} a_i z^{-1}, \text{ where } a_i,\ i = 1, 2, \ldots, M$$

are the short-term predictor coefficients.

After process 316 is completed, the control flows to node 350, which is labeled "A", and which is identical to node 402 in FIG. 4. This completes the description of processing steps that are performed only during good frames. The processing steps that are performed only during bad frames are described next.

If the answer to decision step 304 is "Yes" (i.e. the current frame is erased), then decision step 318 further determines whether the current frame is the first frame in this current stream of erasure. If the answer is "Yes", the current frame is a class-1 frame, then processes 320, 322, and 324 are performed. These three processes can be performed in any order, not necessarily in the particular order shown in FIG. 3.

Process 320 calculates a "voicing measure" on the current frame of decoded speech. A voicing measure is a single figure of merit whose value depends on how strongly voiced the underlying speech signal is. If the current frame of the decoded speech waveform is strongly voiced and highly periodic (such as in vowel regions), the voicing measure calculated by process 320 will have a high value. If the speech is strongly unvoiced (random and noise-like, as in fricative consonants), the voicing measure will have a low value. If the speech is neither of the two, such as a mixture or in a transition region, then the voicing measure will have an intermediate value. There are many techniques for estimating a voicing measure, many of which use pitch prediction gain, normalized autocorrelation, zero-crossing rate, or a combination thereof. These techniques are well known by persons skilled in the art. Any reasonable voicing measure estimator can be used in process 320.

Process 322 calculates the average change of the pitch period during the last few frames if the pitch periods in the last few frames are within a small range (which is the case in voiced regions of speech). This average of frame-to-frame pitch period change is generally a fractional number (i.e., a non-integer). It is used subsequently to process class-2 frames. If the pitch period changes greatly, then the average change of the pitch period is artificially set to zero so that process 328 will not subsequently produce undesired results.

Process 324 calculates the ringing signal of a cascaded long-term synthesis filter and short-term synthesis filter. For voiced speech, this ringing signal tends to naturally "extend" the speech waveform in the last frame into the current frame in a smooth manner. Hence, it is useful to overlap-add the ringing signal with a periodically extrapolated speech waveform in process 332 (to be described later) to ensure a smooth waveform transition from the last frame to the current lost frame.

The long-term synthesis filter may be single-tap or multi-tap. For simplicity, a single-tap long-term synthesis filter may be used. A common way to implement a single-tap all-pole long-term synthesis filter is to maintain a long delay line (that is, a "filter memory") with the number of delay elements equal to the maximum possible pitch period. Since the filter is an all-pole filter, the samples stored in this delay line are the same as the samples in the output of the long-term synthesis filter. To save the data RAM memory required by this long delay line, in one preferred embodiment of the present invention, such a delay line is eliminated, and the portion of the delay line required for long-term filtering operation is approximated and calculated on-the-fly from the decoded speech buffer.

For convenience of description, let us use a vector notation to illustrate how this scheme works. Let the notation x(1:N) denote an N-dimensional vector containing the first through the N-th element of the x( ) array. In other words, x(1:N) is a short-hand notation for the vector [x(1) x(2) x(3) . . . x(N)] if x(1:N) is a row vector. Let xq( ) be the output speech buffer. Further let F be the frame size in samples, Q be the number of previous output speech samples in the xq( ) buffer, and let L be the length of overlap-add operation used in process 332 of FIG. 3. Then, the vector xq(1:Q) corresponds to the previous output speech samples up to the last sample of the last frame, the vector xq(Q+1:Q+F) corresponds to the current frame, and the purpose of process 324 is to calculate a filter ringing signal corresponding to xq(Q+1:Q+L).

To calculate a filter ringing signal corresponding to the time period of xq(Q+1:Q+L), the portion of the long-term filter memory required for such operation is one pitch period earlier than the time period of xq(Q+1:Q+L). Let e(1:L) be the portion of the long-term synthesis filter memory (i.e., the long-term synthesis filter output) that when passed through the short-term synthesis filter will produce the desired filter ringing signal corresponding to the time period of xq(Q+1:Q+L). In addition, let pp be the pitch period to be used for the current frame. Then, the vector e(1:L) can be approximated by inverse short-term filtering of xq(Q+1-pp:Q+L-pp).

This inverse short-term filtering is achieved by first assigning xq(Q+1-pp-M:Q-pp) as the initial memory (or "states") of a short-term predictor error filter, represented as A(z)=1−P(z), and then filter the vector xq(Q+1-pp:Q+L-pp) with this properly initialized filter A(z). The corresponding filter output vector is the desired approximation of the vector e(1:L). Let us call this approximated vector ẽ(1:L). It is saved for later use in process 332. It is only an approximation because the coefficients of A(z) used in the current frame may be different from an earlier set of the coefficients of A(z) corresponding to the time period of xq(Q+1-pp:Q+L-pp) if pp is large.

If desirable, the previous few sets of A(z) coefficients can be stored, and depending on the pitch period pp, the proper set or sets of A(z) coefficients can be retrieved and used in the inverse short-term filtering above. Then, the operation will be exactly equivalent to maintaining the long delay line of the long-term synthesis filter. However, doing so will cost extra memory for the stored sets of A(z) coefficients, and deciding when to use which set of A(z) coefficients can be complicated and cumbersome. In practice, it has been found that by not storing previous sets of A(z) coefficients and just using the current set of A(z) coefficients, more memory is saved while still achieving satisfactory results. Therefore, this simpler approach is used in a preferred embodiment of the present invention.

Note that the vector xq(Q+1-pp-M:Q-pp) contains simply the M samples immediately prior to the vector xq(Q+1-pp:Q+L-pp) that is to be filtered, and therefore it can be used to initialize the memory of the all-zero filter A(z) so that it is as if the all-zero filter A(z) had been filtering the xq( ) signal since before it reaches this point in time.

After the inverse short-term filtering of the vector xq(Q+1-pp:Q+L-pp) with A(z), the resulting output vector ẽ(1:L) is multiplied by a long-term filter memory scaling factor β, which is an approximation of the tap weight for the single-tap long-term synthesis filter used for generating the ringing signal. The scaled long-term filter memory β ẽ(1:L) is an approximation of the long-term synthesis filter output for the time period of xq(Q+1:Q+L). This scaled vector β ẽ(1:L) is further passed through an all-pole short-term synthesis filter represented by 1/A(z) to obtain the desired filter ringing signal, designated as r(1:L). Before the 1/A(z) filtering operation starts, the filter memory of this all-pole filter 1/A(z) is initialized to xq(Q-M+1:Q)—namely, to the last M samples of the output speech of the last frame. This filter memory initialization is done such that the delay element corresponding to $\alpha_i$ is initialized to the value of xq(Q+1−i) for i=1, 2, . . . , M.

Such filter memory initialization for the short-term synthesis filter 1/A(z) basically sets up the filter 1/A(z) as if it had been used in a filtering operation to generate xq(Q−M+1:Q), or the last M samples of the output speech in the last frame, and is about ready to filter the next sample xq(Q+1). By setting up the initial memory (filter states) of the short-term synthesis filter 1/A(z) this way, and then passing β ẽ(1:L) through such a properly initialized short-term synthesis filter, a filter ringing signal will be produced that tends to naturally "extend" the speech waveform in the last frame into the current frame in a smooth manner.

After process 324 calculates the filter ringing signal vector r(1:L) it saves it for later use in process 332. The process then proceeds to decision step 330, which will be described below.

If decision step 318 determines that the current frame is not the first frame in this current stream of erasure, then the foregoing steps 320, 322 and 324 are bypassed and control is passed to decision step 326. Decision step 326 determines whether the current frame is the second frame in the current erasure. If the answer is "Yes", then process 328 changes the pitch period by adding the average pitch period change previously calculated in process 322 to the pitch period of the last frame and uses the resulting value as the new pitch period for this frame. Control flow then passes to decision step 330. If the answer is "No", on the other hand, the control flow skips process 328 and goes directly to decision step 330.

Note that the average pitch period change calculated in process 322 is in general a fractional number. Therefore, if an embodiment of the invention uses only integer pitch period for periodic waveform extrapolation, then process 328 will round off the updated pitch period to the nearest integer.

Decision step 330 determines whether the voicing measure calculated in process 320 has a value greater than a first threshold value T1. If the answer is "No", the waveform in the last frame is considered not to have any periodicity in it to warrant doing any periodic waveform extrapolation, then process 332 is skipped and the control flow goes to decision step 334. On the other hand, if the answer is "Yes", the waveform in the last frame is considered to have at least some degree of periodicity, then process 332 performs periodic waveform extrapolation with overlap-add waveform smoothing.

Process 332 basically performs the operations of blocks 140, 145, and 150 as described above in reference to FIG. 1. Specifically, let t be the extrapolation scaling factor, and assume that the pitch period is greater than the overlap-add period (i.e., pp≧L), then process 332 first calculates xq(Q+1:Q+L)=t×xq(Q+1-pp:Q+L-pp). Next, xq(Q+1:Q+L) is overlap-added with r(1:L). That is, xq(Q+n)=wu(n)×xq(Q+n)+wd(n)×r(n), for n=1, 2, . . . , L, where wu(n) and wd(n) are the n-th sample of the ramp-up window and ramp-down window, respectively, and wu(n)+wd(n)=1. This is the first-stage extrapolation with overlap-add.

Finally, process 332 further extrapolates the speech signal to K samples after the end of the current frame, where K can be the same as L but in general can be different. This second-stage extrapolation is carried out as xq(Q+L+1:Q+F+K)=t×xq(Q+L+1-pp:Q+F+K-pp). The value of K is the length of the long overlap-add window for the first good frame after an erasure, which is the overlap-add length used in process 314. The extra K samples of extrapolated speech past the end of the current frame, namely, the samples in xq(Q+F+1:Q+F+K), is considered the "ringing signal" for the overlap-add operation at the beginning of the next frame.

If the pitch period is smaller than the overlap-add period (pp<L), the first-stage extrapolation is instead performed in a sample-by-sample manner to avoid copying waveform discontinuity from the beginning of the frame to a pitch period later before the overlap-add operation is performed. Specifically, the first-stage extrapolation with overlap-add should be performed by the following algorithm.

For n from 1, 2, 3, . . . , to L, do the next line:

$$xq(Q+n)=wu(n)\times t\times xq(Q+n-pp)+wd(n)\times r(n)$$

In fact, this algorithm works regardless of the relationship between pp and L; therefore, in an embodiment it is used for all to avoid the checking of the relationship between pp and L.

After decision step 330 or process 332 are done, then decision step 334 determines whether the voicing measure calculated in process 320 is less than a second threshold T2. If the answer is "No", the waveform in the last frame is considered highly periodic and there is no need to mix in any random, noisy component in the output speech; hence, processes 336 through 344 are skipped, and the control flow goes to decision step 346.

If, on the other hand, the answer to decision 334 is "Yes", then processes 336 through 344 generate a white noise sequence, filter the noise with the short-term synthesis filter, and potentially mix the filtered noise with the periodically extrapolated speech produced by process 332.

Process 336, which has its counterpart as block 155 in FIG. 1, generates a sequence of pseudo-random white noise. Ideally the noise should not have a uniform distribution and instead should have a Gaussian or similar distribution. There are multiple ways to implement this block. For example, the noise sequence can be calculated sample-by-sample on-the-fly, first using a well-known algorithm to calculate a pseudo-random number with a uniform probability distribution function (PDF), and then use a mapping to map this random number to a warped scale so that the resulting number has a Gaussian PDF. However, this approach costs significant amount of computational complexity.

An alternative is to store an array of pre-calculated white Gaussian noise samples and just sequentially read off this array to obtain the desired number of noise samples. A potential problem with this approach is that if an extended frame erasure of many lost frames requires more noise samples than are stored in this pre-calculated noise array, then the output noise sequence will repeat a fixed pattern, potentially give rise to unwanted periodicity that sounds like a buzz. To avoid this situation, a fairly large number of noise samples need to be stored in this array. For example, if the worst case is to generate 60 ms of white noise before the output speech is attenuated to zero by process 348, then for 16 kHz wideband signals, this pre-calculated noise array would have to store 16×60=960 samples of pre-calculated white Gaussian noise.

In a preferred embodiment of the present invention, process 336 generates the pseudo-random Gaussian white noise sequence using a special table look-up method with modulo indexing. This method avoids the high computational complexity of the on-the-fly calculation method and the high storage requirement of the ordinary table look-up method, both described above. This method is illustrated below in an example.

Suppose the sampling rate is 16 kHz, the frame size is F=80 samples (5 ms), and the number of extra samples extrapolated beyond the end of the current frame is K=40 samples. Then, process 336 will need to generate F+K=120 samples of white noise at a time. The method will first find the smallest prime number that is greater than this number of 120. The resulting prime number is 127. Then, the method will pre-calculate off-line 127 samples of pseudo-random Gaussian white noise and store such 127 noise samples in a table. Let wn(1:127) be the vector containing these 127 noise samples. Let c be the number of bad frames into an erasure that the current bad frame is located. For example, if the current frame is the first bad frame in an erasure, then c=1; if the current frame is the second consecutive bad frame into the current erasure, then c=2, and so on. Then, the n-th sample of the noise sequence generated by this method is obtained as $w(n)=\overline{m}\times wn(\mathrm{mod}(cn,127))$, for n=1, 2, 3, . . . , 120, where $\overline{m}$ is the desired scaling factor, or "gain", to bring the w(n) sequence to a proper signal level. The modulo index "mod(cn,127)" means the remainder of cn after cn is divided by 127. It can be defined as $$\mathrm{mod}(cn, 127) = cn - \left\lfloor \frac{cn}{127} \right\rfloor \times 127,$$

where the symbol ⌊x⌋ means the largest integer that is not greater than x.

For example, for the first frame into the erasure, the first 120 samples of the stored white noise table wn(1:127) is used as the output white noise. For the second frame into the erasure, wn(2), wn(4), wn(6), wn(8), . . . , wn(126), wn(1), wn(3), wn(5), . . . , wn(113) are used as the 120 samples of output white noise. For the third frame into the erasure, the output white noise sequence will be wn(3), wn(6), wn(9), wn(12), . . . , wn(123), wn(126), wn(2), wn(5), wn(8), . . . , wn(122), wn(125), wn(1), wn(4), wn(7), . . . , wn(106). Similarly, for the fourth frame into the erasure, the output white noise sequence will be wn(4), wn(8), wn(12), wn(16), . . . , wn(120), wn(124), wn(1), wn(5), wn(9), . . . , wn(121), wn(125), wn(2), wn(6), wn(10), . . . , wn(122), wn(126), wn(3), wn(7), wn(11), . . . , wn(99).

As can be seen from the four examples above, for each new frame further into the erasure, 120 samples out of the stored white noise table wn(1:127) are extracted in a different pattern without any repetition of noise pattern from one frame to the next. Of course, if c is very large, then eventually the noise pattern will repeat. However, for practical purpose where the output speech will be attenuated to zero after a long erasure of 60 to 100 ms or more, only 12 to 20 frames of non-repeating noise pattern are needed. The modulo indexing method described above will not repeat the noise pattern for 12 to 20 frames. With only 127 stored noise samples, the method can generate thousands of noise samples without repeating any noise pattern.

In one implementation of the method, to save computation instruction cycles, the division operation $$\frac{cn}{127}$$

is never performed. Instead, a counter is initialized to zero and each time before a new sample is taken from the white noise table, this counter is incremented by c and compared with the prime number 127. If it is smaller, the value of the counter is used as the address to the white noise table to extract the noise sample. If the counter is greater than 127, then 127 is subtracted from the counter, and the remainder is used as the address to the white noise table to extract the noise sample. With this implementation approach, only simple addition, subtraction, and comparison operations are needed. In fact, most digital signal processors (DSPs) even have hardware support for efficient modulo indexing.

Once process 336 generates F+K samples of pseudo-random Gaussian white noise, process 338 then passes these noise samples through the all-pole short-term synthesis filter 1/A(z) with initial filter memory set to the last M output speech samples of the last frame, in a like manner to how the memory of the all-pole short-term synthesis filter is initialized in process 324. After the noise sequence passes through this short-term synthesis filter, the filtered noise signal will have roughly the same spectral envelope as the output speech in the last frame. These F+K samples of filtered noise signal are stored for later use in process 342.

Next, decision step 340 determines whether the voicing measure calculated in process 320 is greater than the threshold T1. If the answer is "No", then the waveform in the last frame is considered not to have any periodicity in it, so there is no need to mix the filtered noise signal with the periodically extrapolated speech signal calculated in process 332. Therefore, the first F samples of the filtered noise signal are used as the output speech signal xq(Q+1:Q+F).

If the answer to decision 340 is "Yes", then given that decision step 340 is in the "Yes" branch of decision step 334, it can be concluded that the voicing measure is between threshold T1 and threshold T2. In this case, process 342 mixes the filtered noise signal produced by process 338 and the periodically extrapolated speech signal produced by process 332. Before the mixing, appropriate scaling factors $G_r$ and $G_p$ need to be derived for the two signal components respectively, with $G_r+G_p=1$. If the voicing measure approaches T1, the scaling factor $G_r$ for the filtered noise should approach 1 and the scaling factor for the periodically extrapolated speech should approach 0. Conversely, if the voicing measure approaches T2, then $G_r$ should approach 0 and $G_p$ should approach 1. For simplicity, the scaling factor $G_r$ for the filtered noise can be calculated as $G_r=(T2-v)/(T2-T1)$, where v is the voicing measure. After $G_r$ is calculated, $G_p$ can be calculated as $G_p=1-G_r$.

Assume that the periodically extrapolated speech calculated in process 332 is stored in xq(Q+1:Q+F+K), and the filtered noise calculated in process 338 is stored in fn(1:F+K). Then, once the scaling factors $G_r$ and $G_p$ are calculated, process 342 mixes the two signals as $xq(Q+n)=G_r \times fn(n)+G_p \times xq(Q+n)$, for n=1, 2, . . . , F+K and stores the mixed signal in the output signal buffer.

Next, decision 346 checks whether the current erasure is too long—that is, whether the current frame is too "deep" into the erasure. A reasonable threshold is somewhere around 20 to 30 ms. If the length of the current erasure has not exceeded such a threshold, then the control flow goes to node 350 (labeled "A") in FIG. 3, which is the same as node 402 in FIG. 4. If the length of the current erasure has exceeded this threshold, then process 348 applies gain attenuation which has the effect of gradually reducing the magnitude of the output signal toward zero, and then the control flow goes to node 350. This gain attenuation toward zero is necessary, because extrapolating a waveform for too long will cause the output signal to sound unnaturally tonal and buzzy, which will be perceived as fairly bad artifacts. To avoid the unnatural tonal and buzzy sound, it is reasonable to attenuate the output signal to zero after about 60 ms to 80 ms. Persons skilled in the relevant art will understand that there are various ways to perform such gain attenuation and thus this step will not be discussed here. This completes the description of the frame-erasure-specific processing in FIG. 3.

In reference to FIG. 4, after the processing in FIG. 3 is done, process 404 plays back the output signal samples contained in the vector xq(Q+1:Q+F) through a digital-to-analog (D/A) converter. Process 406 then calculates the short-term prediction residual signal for the current frame, by passing the output signal vector xq(Q+1:Q+F) through the short-term prediction error filter A(z), with the initial filter memory left at what it was after such filtering in process 406 of the last frame. Process 406 is performed for every frame.

Process 408 calculates the "gain" of the short-term prediction residual signal that was calculated in process 406. This gain is stored and later used as the average gain $\overline{m}$ by process 336 in the next frame during the generation of the white noise, which is calculated using the equation $w(n)=\overline{m} \times wn(mod(cn,127))$. This "gain" can be one of many possible quantities that somehow represent how high the signal level is. For example, it could be the average magnitude of the short-term prediction residual signal in the current frame. It could also be the root-mean-square (RMS) value of the short-term prediction residual signal or other measures of gain. Any of such quantities can be chosen as the "gain", as long as it is used in a manner consistent with how process 336 generates a white noise sequence.

Next, decision 410 determines whether the current frame is erased. If the answer is "Yes", then processes 412, 414, and 416 are skipped, and the control flow goes to process 418. If the answer is "No", that means the current frame is a good frame, then process 412, 414, and 416 are performed.

Process 412 may use any one of a large number of possible pitch estimators to generate an estimated pitch period pp that may be used by processes 320, 322, 324, 328, and 332 in the next frame. Since pitch estimation is well-known in the art, it will not be discussed in any detail with reference to process 412. However, since process 412 is performed only during good frames, it should be noted that if the pitch estimator algorithm used in process 412 requires certain processing steps to be performed for every single frame of the speech signal, then such processing steps may be inserted as additional processes between process 408 and decision step 410.

Process 414 calculates the extrapolation scaling factor t that may be used by process 332 in the next frame. Again, there are multiple ways to do this. One way is to calculate the optimal tap weight for a single-tap long-term predictor which predicts xq(Q+1:Q+F) by a weighted version of xq(Q+1-pp:Q+F-pp). The optimal weight, the derivation of which is well-known in the art, can be used as the extrapolation scaling factor t. One potential problem with this more conventional approach is that if the two waveform vectors xq(Q+1:Q+F) and xq(Q+1-pp:Q+F-pp) are not well-correlated (i.e. the normalized correlation is not close to 1), then the periodically extrapolated waveform calculated in process 332 will tend to decay toward zero quickly. One way to avoid this problem is to divide the average magnitude of the vector xq(Q+1:Q+F) by the average magnitude of the vector xq(Q+1-pp:Q+F-pp), and use the resulting quotient as the extrapolation scaling factor t. In the special case when the average magnitude of the vector xq(Q+1-pp:Q+F-pp) is zero, t can be set to zero. In addition, if the correlation between xq(Q+1:Q+F) and xq(Q+1-pp:Q+F-pp) is negative, the value of the quotient calculated above can be negated and the resulting value can be used as t. Finally, to prevent the extrapolated waveform from "blowing up", the value of t can be range bound so that its magnitude does not exceed 1.

Process 416 calculates the long-term filter memory scaling factor β that may be used in process 324 in the next frame. A more conventional way to obtain this value β is to calculate the short-term prediction residual signal first, and then calculate the optimal tap weight of the single-tap long-term predictor for this short-term prediction residual at a pitch period of pp. The resulting optimal tap weight can be used as β. However, doing so requires a long buffer for the short-term prediction residual signal. To reduce the computational complexity and the memory usage, it has been found that reasonable performance can be obtained by simply scaling the extrapolation scaling factor t by a positive value somewhat smaller than 1. It is found that calculating the long-term filter memory scaling factor as $\beta=0.75 \times t$ gives good results.

Process 418 updates a pitch period history buffer which may be used by process 322 in the next frame. This is done by first simply shifting the previous pitch period values for the previous frames (which are already stored in the pitch period history buffer) by one position, and then writing the new pitch period pp of the current frame to the position of the pitch period history buffer that was vacated by the shifting process above. If the answer to decision 410 is "No" for the current frame, then the pitch period value pp obtained by process 412 is the pitch period for the current frame. If the answer to decision 410 is "Yes", then the pitch period of the last frame is re-used as the pitch period of the current frame. Either way, the resulting pitch period of the current frame is written to the position in the pitch period history buffer that was vacated by the shifting process above.

Process 420 updates the short-term synthesis filter memory that may be used in processes 324 and 338 in the next frame. This filter memory update operation serves the purpose of initializing the memory of the short-term synthesis filter 1/A (z) before the filtering operations starts in processes 324 and 338 in the next frame. Of course, if processes 324 and 338 individually perform this filter memory initialization as part of the processes, then process 420 can be skipped. Alternatively, the short-term filter memory can be updated in process 420, and then for the next frame processes 324 and 338 can directly use such updated filter memory. In this case, this filter memory initialization is done such that the delay element corresponding to $\alpha_i$ is initialized to the value of xq(Q+F+1−i) for i=1, 2, . . . , M. Note that xq(Q+F+1−i) in the current frame is the same as xq(Q+1−i) in the next frame because the xq( ) buffer is shifted by F samples before the processing goes to the next frame.

Process 422 performs shifting and updating of the output speech buffer. Basically, the process copies the vector xq(1+F: Q+F) to the vector position occupied by xq(1:Q). In other words, the content of the output speech buffer is shifted by F samples.

Process 424 stores the extra samples of the extrapolated speech signal beyond the end of the current frame as the ringing signal for the next frame. In other words, xq(Q+F+1: Q+F+L) is saved as the ringing signal r(1:L). Note that if the next frame is a class-1 frame (that is, the first bad frame in an erasure), this ringing signal r(1:L) will be replaced by a new filter ringing signal r(1:L) calculated by process 324. If the next frame is any other class of frame except class 1, then this ringing signal calculated as r(1:L)=xq(Q+F+1:Q+F+L) will be used as the ringing signal in process 332.

After process 424, the control flow goes to node 426, which is labeled as "END" in FIG. 4. Node 426 denotes the end of the frame processing loop. Then, the control flow goes back to node 302 labeled as "START" to start the frame processing for the next frame. Then the control flow goes through the entire flow chart in FIG. 3 and FIG. 4 again until it reaches node 426 "END" again. This process is repeated for every new frame.

C. HARDWARE AND SOFTWARE IMPLEMENTATIONS

Figure 5:
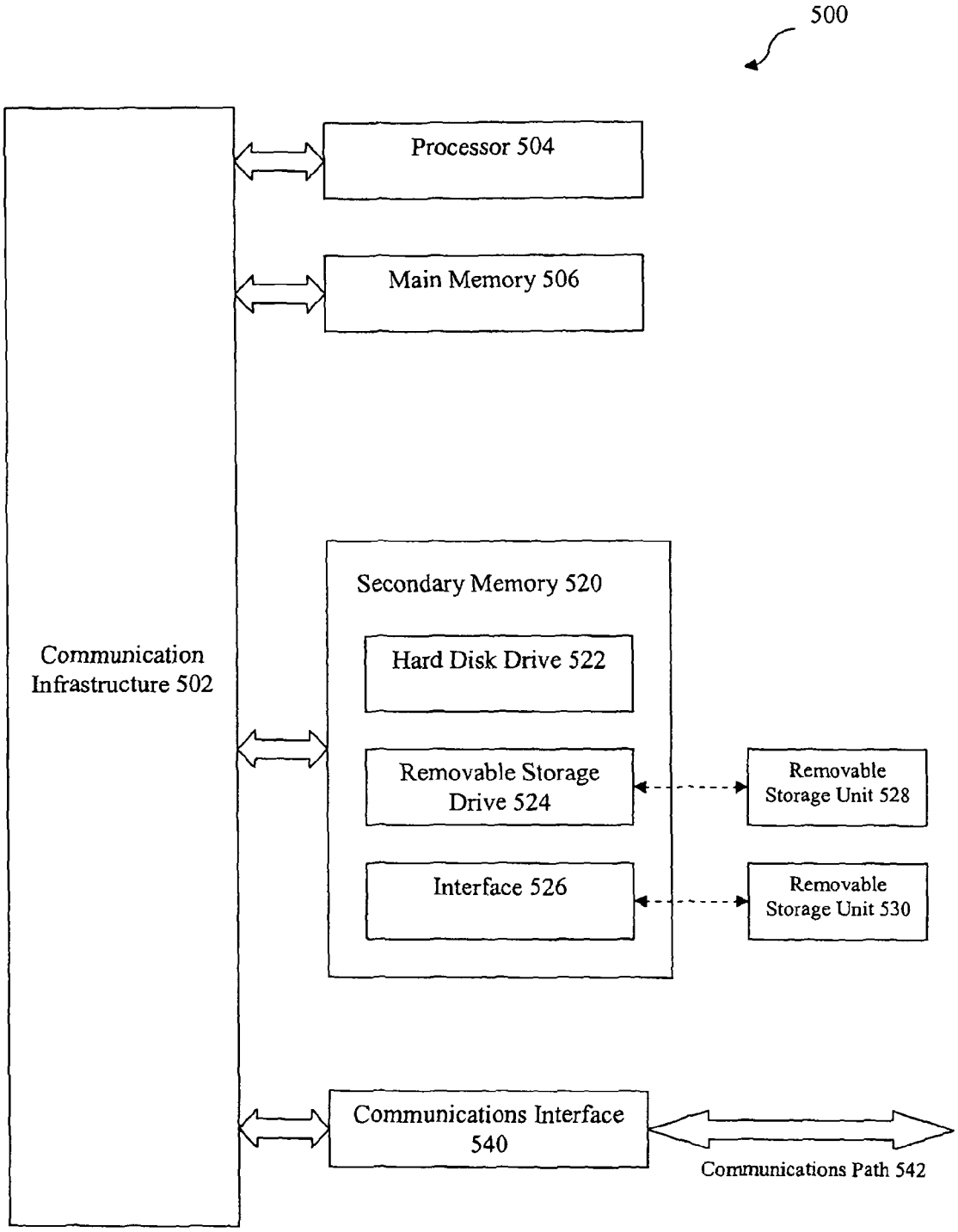
FIG. 5 illustrates an example computer system in which an embodiment of the present invention may be implemented.

The following description of a general purpose computer system is provided for the sake of completeness. The present invention can be implemented in hardware, or as a combination of software and hardware. Consequently, the invention may be implemented in the environment of a computer system or other processing system. An example of such a computer system 500 is shown in FIG. 5. In the present invention, all of the processing blocks or steps of FIGS. 1-4, for example, can execute on one or more distinct computer systems 500, to implement the various methods of the present invention. The computer system 500 includes one or more processors, such as processor 504. Processor 504 can be a special purpose or a general purpose digital signal processor. The processor 504 is connected to a communication infrastructure 502 (for example, a bus or network). Various software implementations are described in terms of this exemplary computer system. After reading this description, it will become apparent to a person skilled in the relevant art how to implement the invention using other computer systems and/or computer architectures.

Computer system 500 also includes a main memory 506, preferably random access memory (RAM), and may also include a secondary memory 520. The secondary memory 520 may include, for example, a hard disk drive 522 and/or a removable storage drive 524, representing a floppy disk drive, a magnetic tape drive, an optical disk drive, or the like. The removable storage drive 524 reads from and/or writes to a removable storage unit 528 in a well known manner. Removable storage unit 528 represents a floppy disk, magnetic tape, optical disk, or the like, which is read by and written to by removable storage drive 524. As will be appreciated, the removable storage unit 528 includes a computer usable storage medium having stored therein computer software and/or data.

In alternative implementations, secondary memory 520 may include other similar means for allowing computer programs or other instructions to be loaded into computer system 500. Such means may include, for example, a removable storage unit 530 and an interface 526. Examples of such means may include a program cartridge and cartridge interface (such as that found in video game devices), a removable memory chip (such as an EPROM, or PROM) and associated socket, and other removable storage units 530 and interfaces 526 which allow software and data to be transferred from the removable storage unit 530 to computer system 500.

Computer system 500 may also include a communications interface 540. Communications interface 540 allows software and data to be transferred between computer system 500 and external devices. Examples of communications interface 540 may include a modem, a network interface (such as an Ethernet card), a communications port, a PCMCIA slot and card, etc. Software and data transferred via communications interface 540 are in the form of signals which may be electronic, electromagnetic, optical or other signals capable of being received by communications interface 540. These signals are provided to communications interface 540 via a communications path 542. Communications path 542 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 528 and 530, a hard disk installed in hard disk drive 522, and signals received by communications interface 540. These computer program products are means for providing software to computer system 500.

Computer programs (also called computer control logic) are stored in main memory 506 and/or secondary memory 520. Computer programs may also be received via communications interface 540. Such computer programs, when executed, enable the computer system 500 to implement the present invention as discussed herein. In particular, the computer programs, when executed, enable the processor 500 to implement the processes of the present invention, such as the methods described with reference to FIGS. 3 and 4, for example. Accordingly, such computer programs represent controllers of the computer system 500. Where the invention is implemented using software, the software may be stored in a computer program product and loaded into computer system 500 using removable storage drive 524, interface 526, or communications interface 540.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

D. CONCLUSION

While various embodiments of the present invention have been described above, it should be understood that they have been presented by way of example, and not limitation. It will be apparent to persons skilled in the relevant art that various changes in form and detail can be made therein without departing from the spirit and scope of the invention. For example, although a preferred embodiment of the present invention described herein utilizes a long-term predictive filter and a short-term predictive filter to generate a ringing signal, persons skilled in the relevant art(s) will appreciate that a ringing signal may be generated using a long-term predictive filter only or a short-term predictive filter only. Additionally, the invention is not limited to the use of predictive filters, and persons skilled in the relevant art(s) will understand that long-term and short-term filters in general may be used to practice the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A method for decoding a speech signal comprising:
decoding one or more non-erased frames of the speech signal;
detecting a first erased frame of the speech signal; and
responsive to detecting the first erased frame:
deriving a filter based on previously-decoded portions of the speech signal, wherein deriving the filter includes determining one or more tap weights of the filter;
calculating a ringing signal segment using the filter; and
generating a replacement frame for the first erased frame, wherein generating the replacement frame includes overlap adding the ringing signal segment to an extrapolated waveform.

2. The method of claim 1, wherein deriving the filter comprises deriving both a long-term filter and a short-term filter and wherein calculating the ringing signal segment using the filter comprises calculating the ringing signal segment using both the long-term and short-term filters.

3. The method of claim 2, wherein deriving the long-term filter comprises calculating a long-term filter memory based on previously-decoded portions of the speech signal.

4. The method of claim 3, wherein calculating the long-term filter memory based on previously-decoded portions of the speech signal comprises inverse short-term filtering a previously-decoded portion of the speech signal.

5. The method of claim 1, further comprising:
detecting one or more subsequent erased frames of the speech signal, the one or more subsequent erased frames immediately following the first erased frame in time; and
calculating a ringing signal segment for each of the subsequent erased frames using the filter.

6. The method of claim 1, further comprising:
detecting one or more subsequent erased frames of the speech signal, the one or more subsequent erased frames immediately following the first erased frame in time; and
generating a replacement frame for each of the one or more subsequent erased frames, wherein generating a replacement frame includes overlap adding a continuation of a waveform extrapolation obtained for a previously-decoded frame with a waveform extrapolation obtained for the erased frame.

7. The method of claim 1, further comprising:
detecting a first non-erased frame of the speech signal subsequent in time to the first erased frame; and
calculating a ringing signal segment for the first non-erased frame using the filter.

8. The method of claim 1, further comprising:
detecting a first non-erased frame of the speech signal subsequent in time to the first erased frame; and
overlap adding a continuation of a waveform extrapolation obtained for a previously-decoded frame with a portion of the first non-erased frame.

9. The method of claim 8, wherein overlap adding the continuation of the waveform extrapolation obtained for a previously decoded-frame with the portion of the first non-erased frame includes selecting an overlap add window length.

10. The method of claim 9, wherein selecting an overlap add window length comprises selecting an overlap add window length based on whether a previously-decoded frame of the speech signal is deemed unvoiced.

11. The method of claim 1, wherein decoding one or more non-erased frames of the speech signal comprises decoding one or more non-erased frames of the speech signal in a block-independent manner.

12. A method for decoding a speech signal comprising:
decoding one or more non-erased frames of the speech signal;
detecting an erased frame of the speech signal; and
responsive to detecting the erased frame:
deriving a short-term filter based on previously-decoded portions of the speech signal, wherein deriving the short-term filter includes determining one or more tap weights of the short-term filter,
generating a sequence of pseudo-random white noise samples,
filtering the sequence of pseudo-random white noise samples through the short ten filter to generate an extrapolated waveform, and
generating a replacement frame for the erased frame based on the extrapolated waveform.

13. The method of claim 12, wherein generating a sequence of pseudo-random white noise samples comprises, for each sample to be generated:
calculating a pseudo-random number with a uniform probability distribution function; and
mapping the pseudo-random number to a warped scale.

14. The method of claim 12, wherein generating a sequence of pseudo-random white noise samples comprises:

sequentially reading samples from an array of pre-calculated white Gaussian noise samples.

15. The method of claim 12, wherein generating a sequence of pseudo-random white noise samples comprises:

storing N pseudo-random Gaussian white noise samples in a table, wherein N is the smallest prime number that is greater than t, and wherein t denotes the total number of samples to be generated; and obtaining a sequence of t samples from the table, wherein the n-th sample in the sequence is obtained using an index based on cn modulo N, wherein c is a current number of consecutively erased frames in the speech signal.

16. The method of claim 12, further comprising:

scaling the sequence of pseudo-random white noise samples before filtering the sequence through the short term filter.

17. The method of claim 16, wherein scaling the sequence of pseudo-random white noise samples comprises scaling the sequence of pseudo-random white noise samples by a gain measurement corresponding to a short term prediction residual calculated for a previously-decoded non-erased frame of the speech signal.

18. The method of claim 12, wherein decoding one or more non-erased frames of the speech signal comprises decoding one or more non-erased frames of the speech signal in a block-independent manner.

19. A method for decoding a speech signal, comprising:

decoding one or more non-erased frames of the speech signal;

detecting an erased frame of the speech signal; and responsive to detecting the erased frame:

deriving a short-term filter and a long-term filter based on previously-decoded portions of the speech signal, wherein deriving the short-term filter and the long-term filter includes determining one or more tap weights of the short-term filter and the long-term filter;

generating a periodic waveform component using the short-term filter and long-term filter;

generating a random waveform component using the short-term filter; and generating a replacement frame for the erased frame, wherein generating a replacement frame comprises mixing the periodic waveform component and the random waveform component.

20. The method of claim 19, wherein mixing the periodic waveform component and the random waveform component comprises:

scaling the periodic waveform component and the random waveform component based on the periodicity of a previously-decoded portion of the speech signal; and adding the scaled periodic waveform component and the scaled random waveform component.

21. The method of claim 20, wherein scaling the periodic waveform component and the random waveform component based on the periodicity of a previously-decoded portion of the speech signal comprises:

scaling the periodic waveform component by a scaling factor Gp; and scaling the random waveform component by a scaling factor Gr, wherein Gr is calculated as a function of the periodicity of a previously-decoded portion of the speech signal and wherein Gp=1−Gr.

22. The method of claim 19, wherein deriving the long-term filter comprises calculating a long team filter memory based on previously-decoded portions of the speech signal.

23. The method of claim 22, wherein calculating the long term filter memory based on previously-decoded portions of the speech signal comprises inverse short-term filtering a previously-decoded portion of the speech signal.

24. The method of claim 19, wherein generating a periodic waveform component using the short-term filter and long-term filter comprises:

calculating a ringing signal segment using the long-term and short-term filters; and overlap adding the ringing signal segment to an extrapolated waveform.

25. The method of claim 19, wherein generating a random waveform component using the short-term filter comprises:

generating a sequence of pseudo-random white noise samples; and filtering the sequence of pseudo-random white noise samples through the short term filter to generate the random waveform component.

26. The method of claim 25, wherein generating a sequence of pseudo-random white noise samples comprises, for each sample to be generated:

calculating a pseudo-random number with a uniform probability distribution function; and mapping the pseudo-random number to a warped scale.

27. The method of claim 25, wherein generating a sequence of pseudo-random white noise samples comprises:

sequentially reading samples from an array of pre-calculated white Gaussian noise samples.

28. The method of claim 25, wherein generating a sequence of pseudo-random white noise samples comprises:

storing N pseudo-random Gaussian white noise samples in a table, wherein N is the smallest prime number that is greater than t, and wherein t denotes the total number of samples to be generated; and obtaining a sequence of t samples from the table, wherein the n-th sample in the sequence is obtained using an index based on cn modulo N, wherein c is a current number of consecutively erased frames in the speech signal.

29. The method of claim 25, further comprising:

scaling the sequence of pseudo-random white noise samples before filtering the sequence through the short term filter.

* * * * *

UNITED STATES PATENT AND TRADEMARK OFFICE

CERTIFICATE OF CORRECTION

PATENT NO. : 7,930,176 B2
APPLICATION NO. : 11/234291
DATED : April 19, 2011
INVENTOR(S) : Juin-Hwey Chen It is certified that error appears in the above-identified patent and that said Letters Patent is hereby corrected as shown below:

Column 20, Line 56, “ten” should read --term--;
Column 21, Line 9, “t” should read --*t*--;
Column 21, Line 10, “n-th” should read --*n*-th--;
Column 21, Line 11, “cn” should read --*cn*--, and “c” should read --*c*--;
Column 22, Line 2, “Gp” should read --*Gp*--;
Column 22, Line 4, “Gr” should read --*Gr*--;
Column 22, Line 5, “Gr” should read --*Gr*--;
Column 22, Line 7, “Gp=1-Gr” should read --*Gp*=1-*Gr*--;
Column 22, Line 43, “t” should read --*t*-- (both occurrences);
Column 22, Line 45, “t” should read --*t*--;
Column 22, Line 46, “n-th” should read --*n*-th--; and
Column 22, Line 47, “cn” should read --*cn*--, and “c” should read --*c*--.

Signed and Sealed this
Ninth Day of August, 2011

David J. Kappos

David J. Kappos
*Director of the United States Patent and Trademark Office*